US007278486B2

(12) United States Patent
Alba et al.

(10) Patent No.: US 7,278,486 B2
(45) Date of Patent: Oct. 9, 2007

(54) FRACTURING METHOD PROVIDING SIMULTANEOUS FLOW BACK

(75) Inventors: Ruben A. Alba, Henderson, CO (US); Raymund Meijs, Centennial, CO (US); Gary Walters, Thornton, CO (US); L. Mark Farabee, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 216 days.

(21) Appl. No.: 11/072,725

(22) Filed: Mar. 4, 2005

(65) Prior Publication Data

US 2006/0196667 A1 Sep. 7, 2006

(51) Int. Cl.
*E21B 43/26* (2006.01)

(52) U.S. Cl. ..... 166/308.1; 166/297; 166/298; 166/305.1; 166/312

(58) Field of Classification Search ..... 166/298, 166/308.1, 297, 305.1, 312
See application file for complete search history.

(56) References Cited

U.S. PATENT DOCUMENTS

| | | | | |
|---|---|---|---|---|
| 2,769,497 | A | 11/1956 | Reistle, Jr. | 166/42 |
| 2,986,214 | A | 5/1961 | Wiseman, Jr. et al. | 166/55 |
| 3,353,602 | A * | 11/1967 | Geertsma | 166/303 |
| 5,947,200 | A | 9/1999 | Montgomery | |
| 6,394,184 | B2 | 5/2002 | Tolman et al. | 166/281 |
| 6,520,255 | B2 | 2/2003 | Tolman et al. | 166/281 |
| 6,543,538 | B2 | 4/2003 | Tolman et al. | 166/284 |
| 2002/0195253 | A1 | 12/2002 | Hill, Jr. et al. | |
| 2003/0047311 | A1 | 3/2003 | Echols et al. | |
| 2003/0051876 | A1 | 3/2003 | Tolman et al. | |
| 2004/0040707 | A1 | 3/2004 | Dusterhoft et al. | |
| 2004/0206504 | A1 | 10/2004 | Rosato | 166/298 |

FOREIGN PATENT DOCUMENTS

| | | |
|---|---|---|
| AU | B 11119/76 | 5/1979 |

OTHER PUBLICATIONS

"Coiled Tubing Isolates Zones, Fractures Wells with Single Trip Service" Apr. 1999, XP-000833396; Seth A. Silverman.

"Stimultaneous Stimulations and/or Packing in Multiple Zones. Effective Solutions." Sep. 29, 2002, XP-002380887, SPE 77437; Jorge L. Romero, et al.

(Continued)

*Primary Examiner*—David Bagnell
*Assistant Examiner*—Giovanna M Collins
(74) *Attorney, Agent, or Firm*—John W. Wustenberg; Baker Botts, L.L.P.

(57) ABSTRACT

A bottom-up method of fracturing a multi-zone subterranean formation intersected by a wellbore that enables one zone to be fractured while at the same time flowing previously placed fracture fluid from one or more other zones back to the surface is provided. The method employs a bottom-hole assembly ("BHA") that is attached to the bottom end of a tubing string. The BHA includes a hydra jetting sub, a centralizer, a packer and valve sub. The hydra jetting sub is used to perforate and initiate the fracture in the zones of interest. The zones are fractured by pumping fracturing fluid down the annulus formed between the tubing string and the wellbore. The previously placed fracture fluid flows back to the surface through the tubing string. It enters through the valve sub in the BHA.

27 Claims, 7 Drawing Sheets

OTHER PUBLICATIONS

Foreign commuication related to a counterpart application dated May 31, 2006.

U.S. Patent Application entitled "System and Method For Fracturing A Hydrocarbon Producing Formation" by Michael J. Rosato et al., filed Nov. 5, 2004 as U.S. Appl. No. 10/983,070.

U.S. Patent Application entitled "Methods of Isolating Hydrajet Stimulated Zones" by Ronald M Willett, filed Mar. 24, 2004 as U.S. Appl. No. 10/807,986.

* cited by examiner

FIG.2
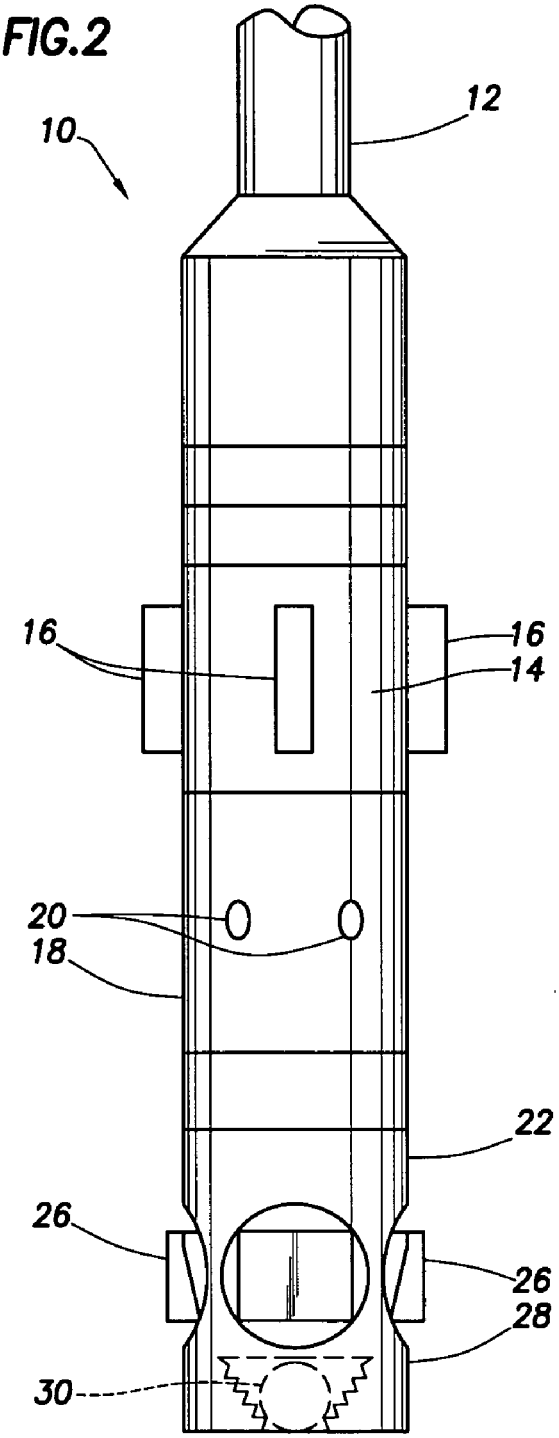
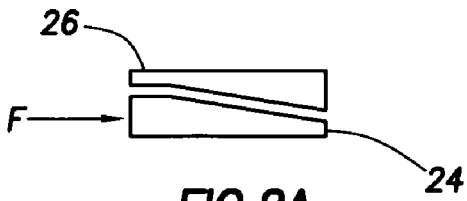
FIG.2A
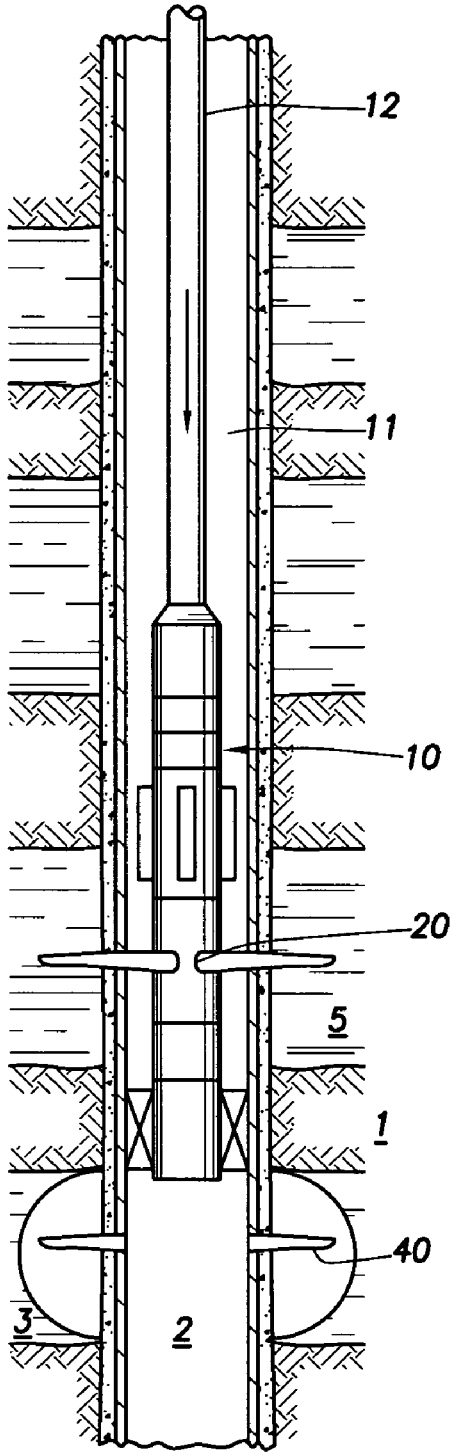
FIG.3A

FRACTURING METHOD PROVIDING SIMULTANEOUS FLOW BACK

BACKGROUND

The present invention relates generally to methods for fracturing subterranean formations having tight lenticular gas sands or multiple pay sands and more particularly to a fracturing method that allows one zone of the formation to be fractured while simultaneously flowing back previously placed stimulation and/or fracture fluids from one or more other zones in the formation.

Many subterranean formations containing hydrocarbon reservoirs suffer from the problem of having insufficient permeability or productivity to enable the hydrocarbons to be recovered at the surface in an effective and economical manner. A number of techniques have been developed to increase the permeability or productivity of these formations. The most common techniques include hydraulically fracturing the subterranean formation and/or chemically stimulating the formation.

Hydraulic fracturing commonly involves injecting fluids into the formation at sufficiently high pressures to cause the formation to fracture. The fractures are then injected with a granular material known as a proppant, which may include sand, ceramic beads or other similar material. The proppants hold the fracture open after the pressure is released. The proppant-filled fractures create a higher permeability flow-path for the hydrocarbons to follow from the reservoir to the wellbore than that occurring naturally in the subterranean formation. Chemical stimulation techniques involve pumping certain chemicals into the formation, such as acid-based fluids, that etch away a path in the formation through which the hydrocarbons can flow or otherwise alter the properties of the formation so as to enhance its permeability.

After the flow paths have been created, regardless of the technique, the treatment fluids that have been injected into the formation must be recovered. The treatment fluids are recovered for a number of reasons. For one, some of these treatment fluids are expensive and can be reused in other fracturing and/or stimulating other wellbores. Furthermore, it is believed that certain treatment fluids, especially water-based treatment fluids, left in the formation for extended periods of time can actually inhibit the flow of hydrocarbons rather than enhance it. This damage can be compounded by time and depth of fluid penetration. The process reduces and in some instances prohibits the hydrocarbons from flowing toward the wellbore. This condition is known as imbibement. The step of producing the fracture or stimulation fluid to the surface is known as "flow back."

In conventional fracture methods, the fracture/stimulation fluids are not circulated back to the surface until after the fracture/stimulation procedure has been completed, which can sometimes take several days or even weeks if multiple zones are being fractured using conventional fracturing/stimulation techniques. After that period of time, the amount of imbibement can be significant.

In addition to the ill effects of imbibement, which are caused using conventional fracture/stimulation methods to complete a well, the time lost associated with these techniques is significant and can result in potentially significant lost revenue. This is because each of the steps associated with fracturing/stimulating a multi-zone formation have conventionally been performed separately. Furthermore, conventional fracturing/stimulation techniques require multiple trips into and out of the well of downhole tools to accomplish the various fracturing/stimulation steps. For example, the steps of perforating the formation, fracturing the formation and flowing the treatment fluid out of the fracture back to the surface all typically require multiple trips of various downhole tools into and out of the well to complete. This can be very time consuming, especially when multiple pay zones are involved.

A number of solutions have been proposed to reduce the number of trips needed to fracture multiple zones in a multi-zone formation. In a number of these solutions, the fractures are formed starting at the bottom of the well and working upward. In one such method, the first fracture is initiated by perforating the formation in the first zone using a gun perforator that has been lowered into the well using a wireline. After the perforations have been formed, a tubing with a packer is lowered and set beneath the perforations. Then the fracture fluid is pumped down the annulus between the tubing and the casing or wellbore as the case may be. After the fracture has been formed, the packer is unset and the tubing raised to a location above the next zone to be fractured. Then the gun perforator is again lowered into the well adjacent to the region to be fractured to perforate that region. The gun perforator is again removed from the well using the wireline. Next, the tubing is lowered and the packer set between the perforated second zone and the fractured first zone. The fracture fluid is then pumped down the annulus into the second zone so as to fracture that zone. This process is repeated if additional zones need to be fractured. After all of the zones have been fractured then the fracture/stimulation fluid is produced. This solution saves a number of process steps by leaving the tubing in the well during the perforating and fracturing steps and by using a removable packer. However, it still requires multiple trips into and out of the well and thus allows for a substantial amount of imbibement to occur.

A number of solutions propose using a bottom-hole assembly ("BHA"), which combines the packer with a multi-stage perforating gun, which in turn is attached to a tubing string or jointed pipe. In one solution, the multi-stage perforating gun is detachably secured to the packer, which is disposed below the perforating gun. In another solution, the packer is attached above the multi-stage perforating gun. In the latter solution, a depth-control device may be incorporated into the BHA or at the surface to assist the well operator in accurately positioning the tool within the wellbore during perforation and fracturing.

The advantage of these solutions is that since the perforating gun is attached to the packer, the perforating gun does not have to be recovered at the surface between perforation steps. Therefore, a plurality of production zones can be perforated and fractured by a single run into the well in a continuous unbroken sequence, without withdrawing the tubing string, perforating gun or packer from the well before all the zones have been perforated and treated. A drawback of this solution, however, is that it does not allow flow back of the hydraulic fracture/stimulation treatment fluid in the multiple zones until after all of the zones have been perforated and fractured. Accordingly, this solution is subject to a certain amount of undesirable imbibement.

Therefore, it is desirable to be able to perforate and fracture multiple production zones in the formation while simultaneously flowing back previously placed hydraulic fractures/stimulation treatment fluids in zones that have already been perforated and fractured all in a single trip. The assignee of the present invention has carried out such a method using a top-down approach, i.e., by perforating and fracturing zones in a sequence starting at a location up hole and working toward the bottom of the well. The tool employed in this method was a BHA having an expandable packer connected to a tubing string, a centralizer connected to the packer, a hydra jetting sub connected to the centralizer and a ball sub connected to the hydra jetting sub, such as the one illustrated in FIG. 1A.

The assignee's prior method is carried out in the following sequence. First, Zone 1 is perforated using the hydra jetting sub, then it is fractured, and then the BHA is moved downhole toward Zone 2 washing down the wellbore in the process, as shown in FIG. 1A. Next, a ball is circulated down the tubing until it reaches the ball sub, as shown in FIGS. 1B and 1C. Once the ball has landed, the fluid exits the jets in the hydra jetting sub to thereby perforate Zone 2, as shown in FIG. 1C. Once Zone 2 has been perforated, the ball is circulated back up the tubing to the surface using the pressure from the formation, as shown in FIG. 1D. Next, the BHA is moved up hole and the packer is set just below Zone 1, as shown in FIG. 1E. Then the fracturing fluid is pumped down the tubing into the perforations in Zone 2 causing Zone 2 to fracture, as shown in FIG. 1E. The previously placed fracture fluid from Zone 1 is simultaneously recovered up the annulus. Next, the BHA is moved downhole toward Zone 3 washing down the wellbore in the process, as shown in FIG. 1F. The BHA is then moved downhole so that the hydra jetting tool is adjacent to Zone 3. The ball is again landed in the ball sub, and then fluid in pumped through the hydra jetting tool to perforate Zone 3, as shown in FIG. 1G. The process continues until all of the desired zones have been perforated, fractured and had their fracturing fluid flowed back to the surface.

The assignee's prior method of simultaneously perforating, fracturing and flowing back multiple zones in a subterranean formation overcomes many of the disadvantages of prior fracturing methods and has proven to be a useful method for treating multiple zones in a subterranean formation in the Northeastern United States. There are some formations, however, where the top-down fracturing method is less than desirable, for example, those found in the United States and Canadian Rockies. Furthermore, top down fracturing has several drawbacks.

The top down completion method requires the fracturing fluid to be pumped down the tubing which results in a larger ID tubing being needed to facilitate the flow rates needed to fracture the reservoir. A drawback of using larger pipe (2.375-2.875 inch diameter) is that it is relatively difficult to handle in the wellbore compared to smaller pipe sizes (1.5-2.0 inch diameter) and is more expensive. Also, in the top down method, the previously placed fracturing fluid is produced up the annulus, which impinges against the tubing string and therefore can cause damage to the tubing string. Furthermore, in the top down method the previously fractured zones are above the packer and flowing these zones back may result in proppant building up on the top of the packer. Additionally, top down completions diminish the annular pressure and mechanical integrity, which can greatly compromise future recompletion efforts.

It is therefore desired to have a bottom-up method of simultaneously perforating, fracturing and flowing back multiple zones that overcomes some of the drawbacks of the assignee of the present invention's prior treatment method.

SUMMARY

The present invention is directed to a method of fracturing a multi-zone subterranean formation intersected by a wellbore. The method includes the step of running a BHA attached to an end of a tubing string into the wellbore adjacent to a first zone to be fractured. The BHA comprises a hydra jetting sub having a plurality of jet ports, a centralizer attached to the hydra jetting sub, and a packer and valve sub attached below the hydra jetting sub. The first zone is perforated by injecting a hydraulic fluid into the subterranean formation through the jet ports of the hydra jetting sub. After the first zone is perforated, the BHA is moved downhole below the first zone. The packer is then set. Next, a fracture fluid is pumped down an annulus formed between the tubing string and the wellbore and into the perforations formed in the first zone. The packer is then unset and the BHA is pulled up hole adjacent to a second zone. The terms "up hole" and "downhole" refer to locations along the wellbore irrespective of depth. Thus, one location in the wellbore may be up hole of another even though the other location is closer to the surface than the other location in absolute depth terms if the up hole location is closer to the surface as measured along the path of the wellbore.

The second zone is then perforated and the fracture initiated by injecting a hydraulic fluid into the subterranean formation through the jet ports of the hydra jetting sub. Then, the BHA is moved downhole between the first zone and the second zone and the packer is set to isolate the first zone from the second zone. A fracture fluid is then pumped down the annulus and into the perforations formed in the second zone. At the same time that the fracture fluid is being pumped down the annulus to fracture the second zone, the previously placed fracturing fluid in the first zone flows back to the surface through the BHA and tubing string. The flow back fluid enters the BHA through the valve sub, which is attached at the bottom end of the BHA.

The method can be repeated for as many zones as are desired to be fractured. The method enables the next zone to be fractured while the previously placed fracture fluid in all the other zones downhole of that zone flows back to the surface via the BHA and tubing string. The packer isolates the zone being fractured from all of the other zones downhole of that zone. Therefore, the present invention provides a bottom-up method of fracturing a multi-zone subterranean formation allowing for simultaneous flow back.

The features and advantages of the present invention will be readily apparent to those skilled in the art upon a reading of the description of the exemplary embodiments, which follows.

BRIEF DESCRIPTION OF THE DRAWINGS

A more complete understanding of the present disclosure and advantages thereof may be acquired by referring to the following description taken in conjunction with the accompanying drawings, which:

FIGS. 2 and 2A illustrate an embodiment of a BHA used in accordance with the method according to the present invention.

FIGS. 3A-3F illustrate use of the BHA shown in FIG. 2 in carrying out the steps of fracturing a multi-zone subterranean formation in accordance with the present invention.

DETAILED DESCRIPTION

Figure 1C:
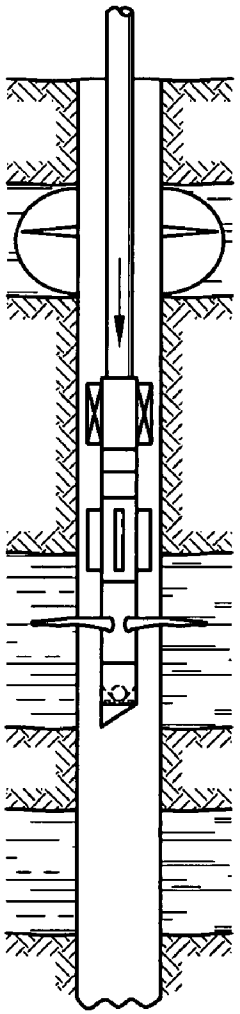
FIG. 1C (PRIOR ART)
FIGS. 1A-1G illustrate the steps in carrying out a prior top-down fracturing method.
Figure 1B:
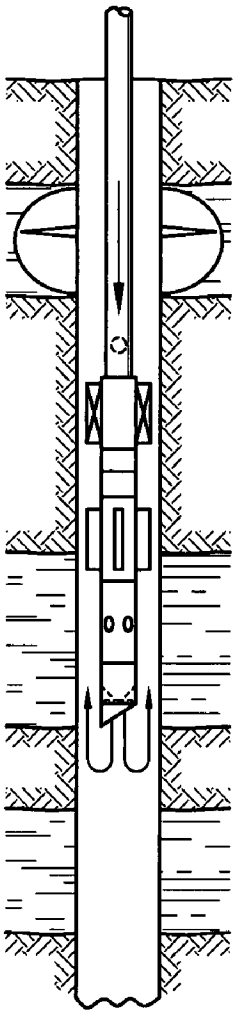
FIG. 1B (PRIOR ART)
Figure 1A:
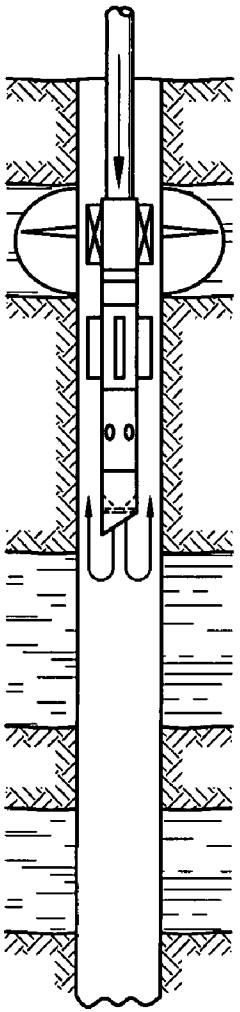
FIG. 1A (PRIOR ART)
Figure 1G:
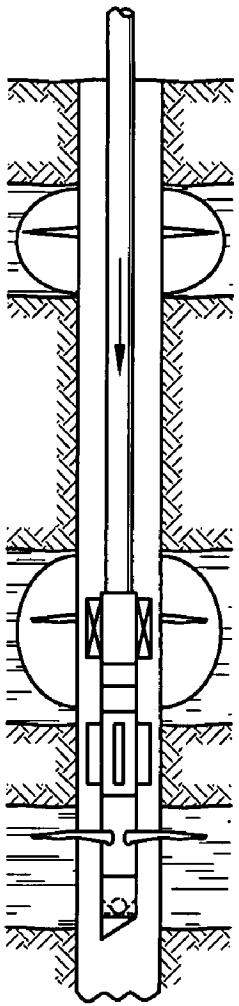
FIG. 1G (PRIOR ART)
Figure 1F:
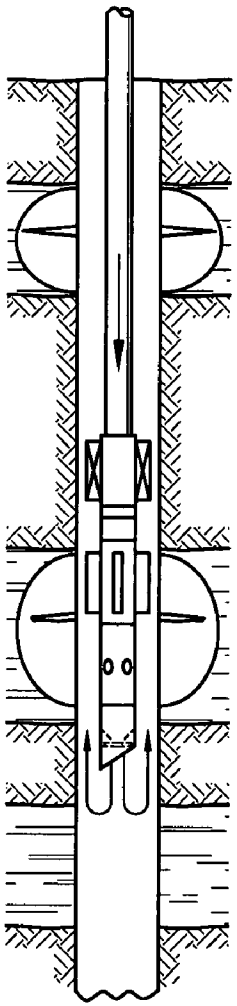
FIG. 1F (PRIOR ART)
Figure 1E:
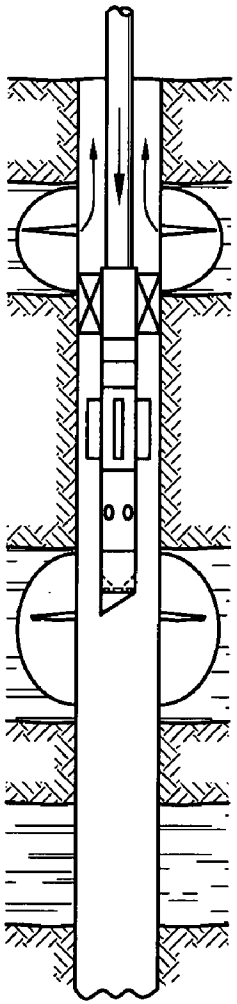
FIG. 1E (PRIOR ART)
Figure 1D:
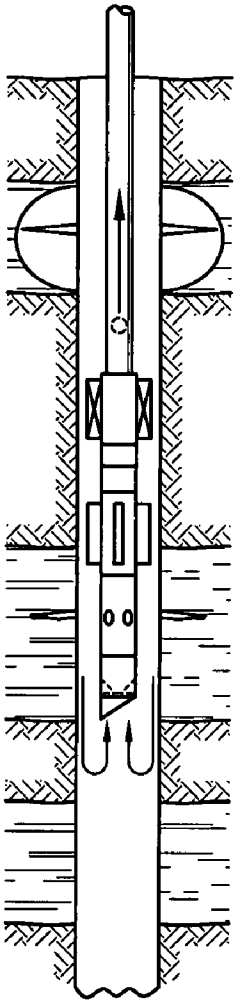
FIG. 1D (PRIOR ART)

The details of the present invention will now be described. Turning to FIG. 2, a BHA for use in the method of the present invention is illustrated generally by reference numeral 10. The BHA 10 is attached to the bottom end of a tubing string 12. The tubing string 12 can be a coiled tubing, jointed tubing or other downhole deployment device that can communicate fluid downhole. The BHA 10 also includes a centralizer sub 14, which includes a plurality of centralizer members 16 which centralize the tool within the casing or open hole of the wellbore as the case may be.

The BHA 10 further includes a hydra jetting sub 18 connected to the centralizer sub 14. The hydra jetting sub 18 includes a plurality of jet ports 20, which direct a hydraulic fluid into the subterranean formation at a very high pressure, specifically a pressure high enough to perforate the subterranean formation and/or initiate a fracture in the subterranean formation. The jet ports 20 include nozzles (not shown) formed of a carbide or ceramic material to resist the corrosive effects of ejecting the hydraulic fluid from the sub at such high pressures.

The BHA 10 further includes a packer 22 connected to the hydra jetting sub 18. The packer 22 is a compression-type packer and operates as follows. By rotating the tubing string 12, a plurality of wedges 24 in the packer align with a corresponding plurality of tapered sealing members 26 (shown in FIG. 2A). By pushing down on the tubing string 12, the downward force (indicated by the arrow F) causes the sealing members 26 via the wedges 24 into engagement with the inside surface of a casing within the wellbore. The packer 22 is unset by pulling up on the tubing string 12 to remove the force on the sealing members 26 applied by the wedges 24 and rotating the tubing string so as to place the wedges out of alignment with the sealing members. As those of ordinary skill in the art will appreciate, other types of re-settable sealing mechanisms besides a compression-type packer can be employed.

The BHA 10 further includes a valve sub 28 connected to the hydra jetting sub 18. The valve sub 28 may include a check valve, such as ball valve 30 (shown in FIG. 2) or a flapper valve or the like. The valve sub 28 permits fluid to flow up the BHA 10 and tubing string 12 when the valve connected to the tubing string 12 at the surface is open and the formation pressure controls the fluid flow. The valve sub 28 blocks flow out of the bottom end of the BHA 10 when the hydraulic fluid ejected from the hydra jetting sub 18 is being pumped down the tubing string 12.

As those of ordinary skill in the art will recognize, the BHA 10 may include additional equipment not shown, e.g., wash tools, circulation port subs, pressure equalization subs, wireline connection subs, pressure gauges, temperature gauges, casing collar locators, shear subs, fishing necks, re-settable mechanical slips, and other auxiliary equipment for handling auxiliary operations and measurements that may be needed downhole during the fracturing method.

A fracturing method in accordance with the present invention will now be described with reference to FIGS. 3A-3F and 4. First, in step 100, a wellbore 2 is drilled into multi-zone subterranean formation 1 using known drilling techniques. Next, in step 102, the BHA 10 is run into the wellbore 2 with the hydra jetting ports 20 being disposed adjacent to the first zone to be fractured in the subterranean formation 3. In step 104, hydraulic fluid is pumped down the tubing string 12 and through the hydra jetting ports 20 into the first zone 3 at sufficient pressure to perforate the first zone. In step 106, the fluid is ejected from ports 20 at sufficient enough pressure and for sufficient enough time to initiate a fracture in the first zone 3. Next, in step 108, the BHA 10 is moved downhole below the first zone 3. In step 110, the packer 22 is set. In step 112, a fracture fluid is pumped down an annulus 11 formed between the tubing string 12 and the wellbore 2 and into the perforations 40 formed in the first zone 3 so as to fracture the first zone 3.

Figure 3B:
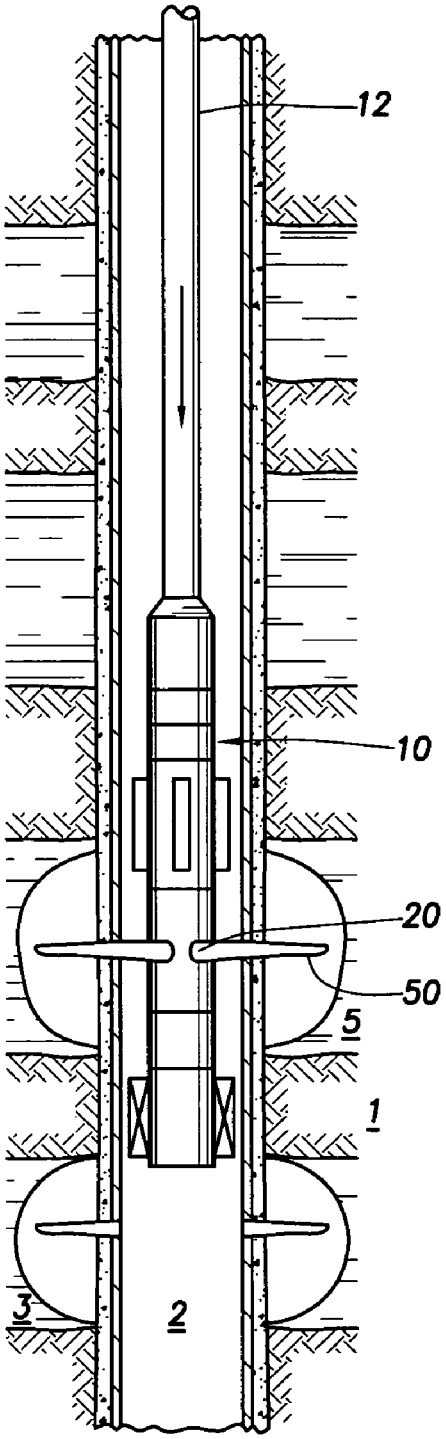
Figure 3C:
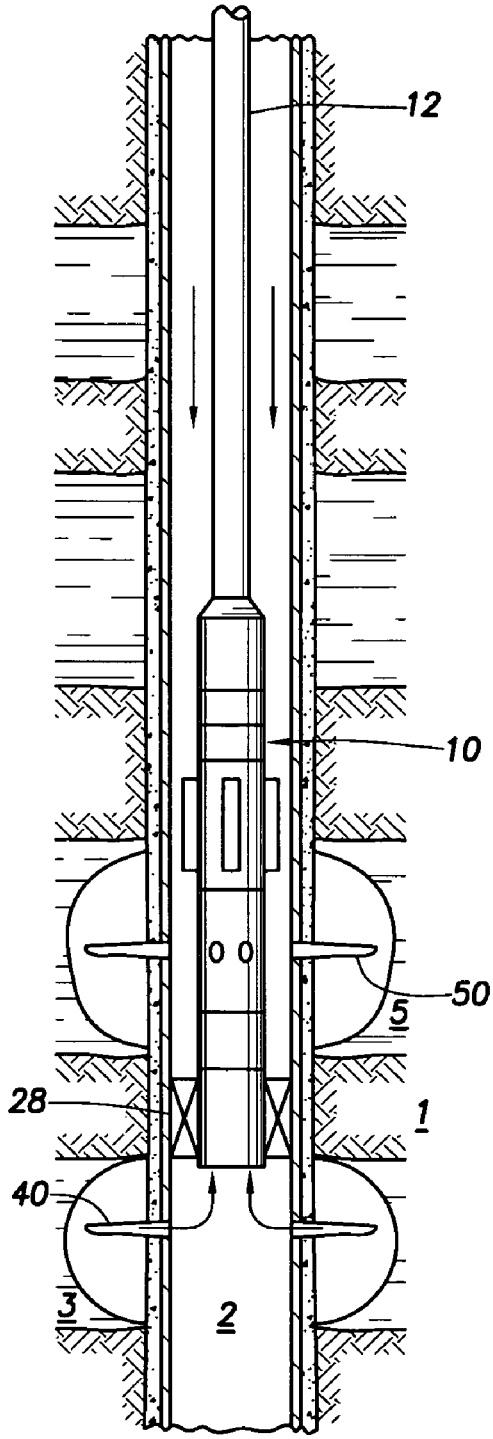

In step 114, the packer 22 is unset. In step 116, the BHA 10 is pulled uphole so that the jet ports 20 of the hydra jetting sub 18 are disposed adjacent to a second zone 5 of the subterranean formation. In step 118, hydraulic fluid is pumped down the tubing string 12 and through the hydra jetting ports 20 into the second zone 5 at sufficient pressure to perforate the second zone, as shown in FIG. 3A. In step 120, the fluid is ejected from ports 20 at sufficient enough pressure and for sufficient enough time to initiate a fracture in the second zone 5, as shown in FIG. 3B. In step 122, the packer 22 is set between the first zone 3 and the second zone 5. Next, in step 124, a fracture fluid is pumped down an annulus formed between the tubing string 12 and the wellbore 2 and into the perforations 50 formed in the second zone 5 so as to fracture the second zone 5. Next, in step 126, simultaneous with steps 120-124, the previously placed fracturing fluid in the first zone 3 is flowed back to the surface through the BHA 10 and tubing string 12, as indicated by the arrows flowing up the valve sub 28 in FIG. 3C.

Figure 3D:
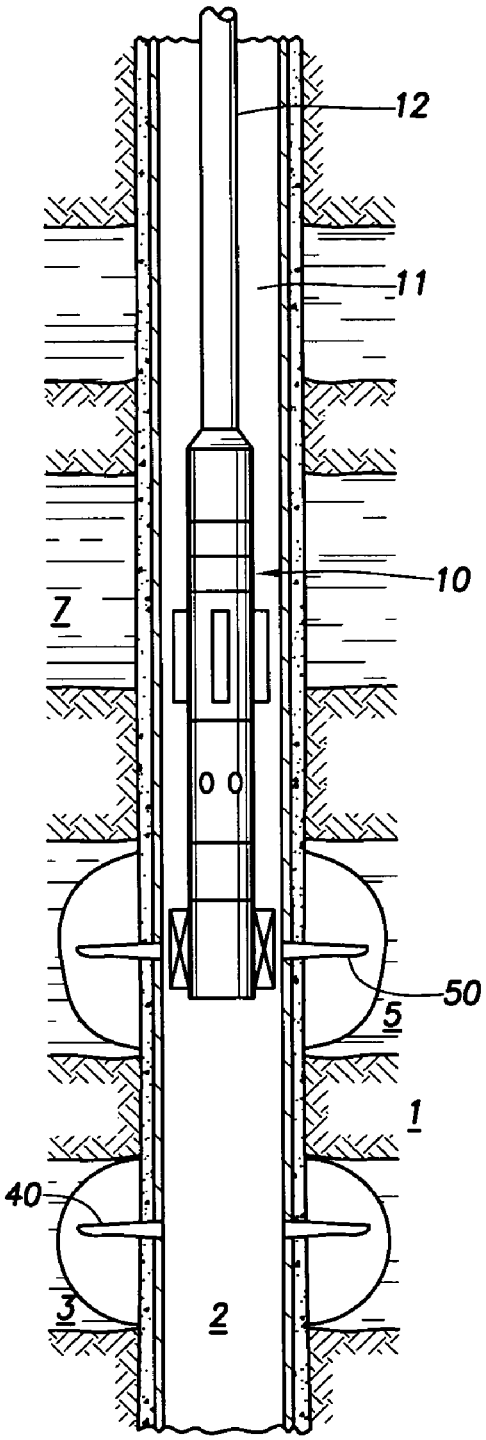
Figure 3E:
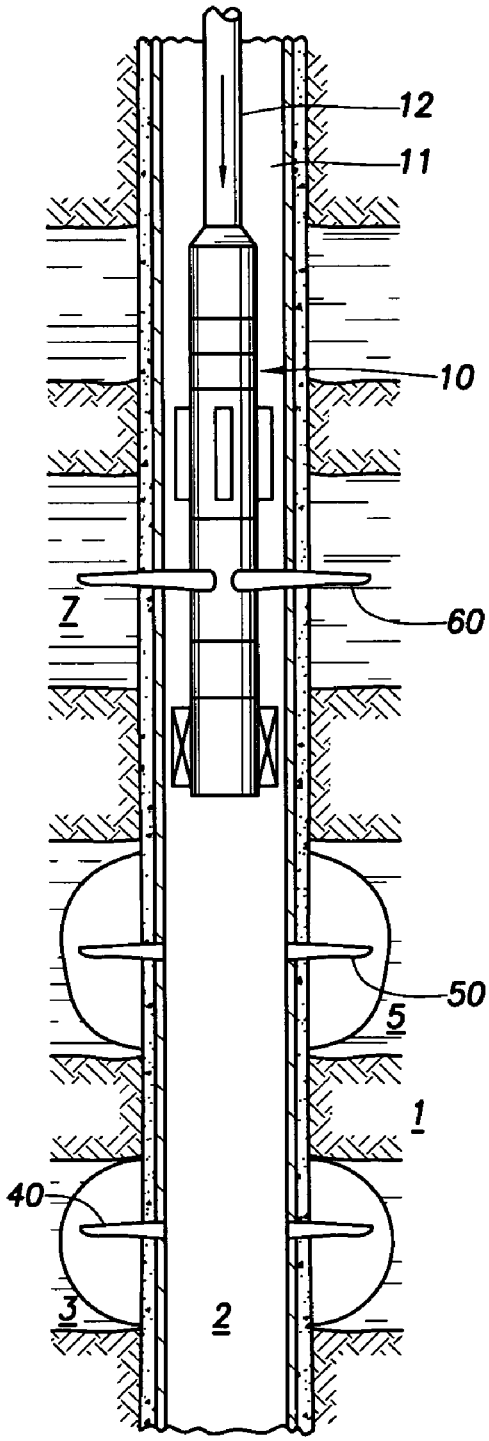
Figure 3F:
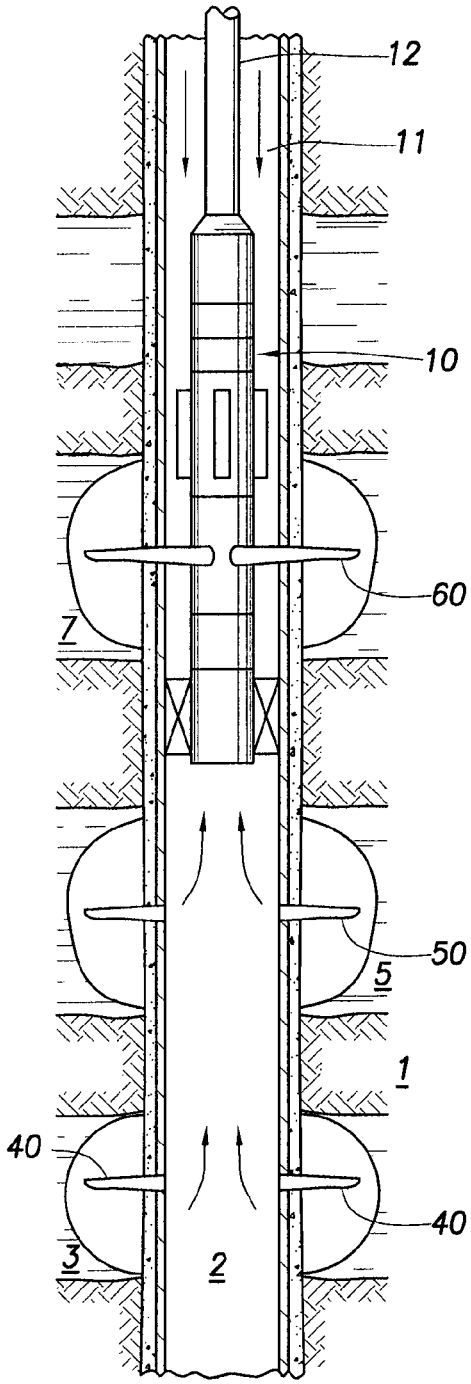
Figure 4A:
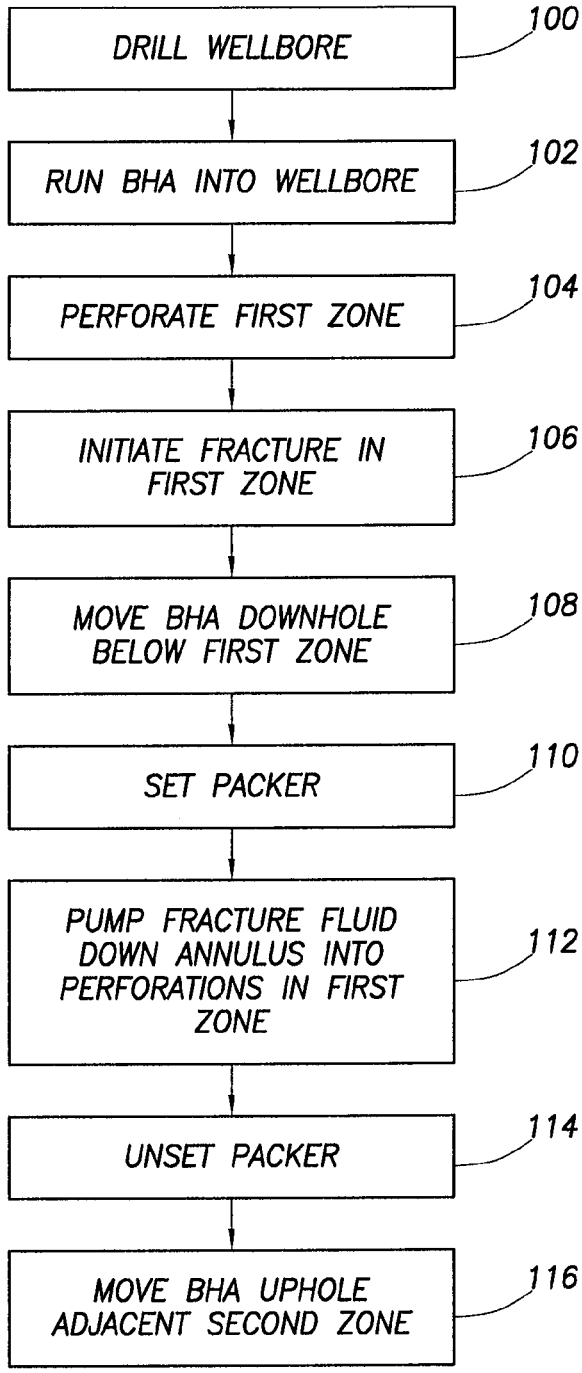
FIGS. 4A and 4B are a flow chart illustrating the steps of fracturing a multi-zone subterranean formation in accordance with the present invention.
Figure 4B:
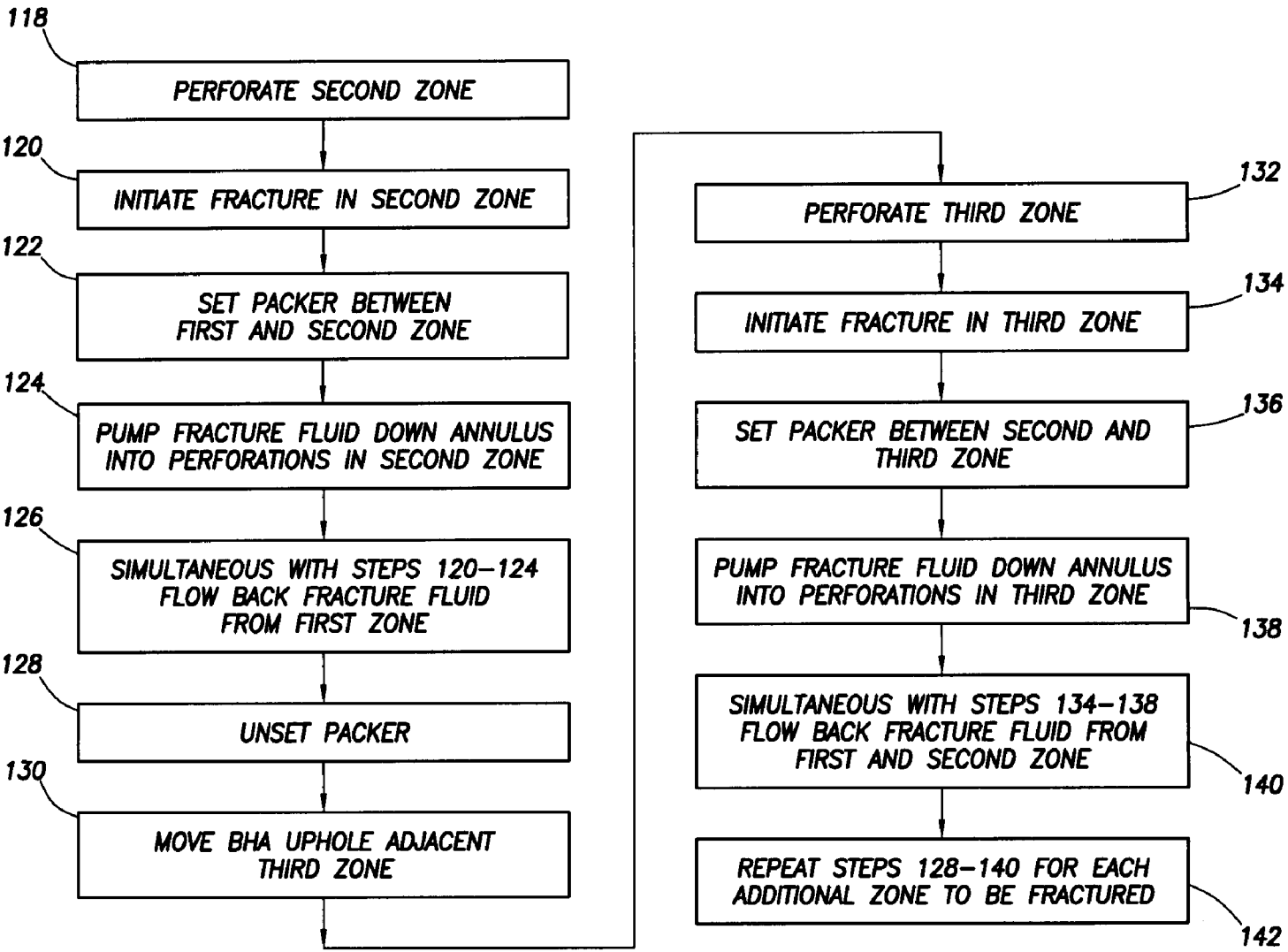

In steps 128 and 130, the packer 22 is unset and the BHA 10 is moved up hole (as shown in FIG. 3D) adjacent to a third zone 7, respectively. In step 132, hydraulic fluid is pumped down the tubing string 12 and through the hydra jetting ports 20 into the third zone 7 at sufficient pressure to perforate the third zone, as shown in FIG. 3E. In step 134, the fluid is ejected from ports 20 at sufficient enough pressure and for sufficient enough time to initiate a fracture in the third zone 7. In step 136, the packer 22 is set between the second zone 5 and third zone 7. Next, in step 138, a fracture fluid is pumped down the annulus 11 and into the perforations 60 formed in the third zone 7 so as to fracture the second zone 5. Next, in step 140, simultaneous with steps 134-138, the previously placed fracturing fluid in the first and second zones 3 and 5 is flowed back to the surface through the BHA 10 and tubing string 12, as indicated by the arrows flowing up the valve sub 28 in FIG. 3F.

Next, step 142, which is to repeat steps 128-140, may be repeated for each additional zone that the well operator desires to fracture. As those of ordinary skill in the art will appreciate, if only two zones are desired to be fractured, only steps 100 through 128 are to be performed. Once all of the desired zones have been fractured, the BHA 10 may be pulled up hole to a location above all of the fractured zones where the packer 22 may be set and the remaining previously placed fracture fluid may be recovered up the BHA 10 and tubing string 12. Alternatively, the BHA 10 can be pulled completely out of the hole and the previously placed fracture fluid may be recovered up the wellbore 2. As those of ordinary skill in the art will also appreciate, not all of the steps that would ordinarily be performed in carrying out the method according to the present invention are described. For example, the wellbore 2 may be lined with a casing, which may or may not be cemented to the wellbore 2. Those of ordinary skill in the art would know under what circumstances to case (or not case) the wellbore 2 and whether such casing should be cemented to the wall of the wellbore 2. Furthermore, the steps of washing the wellbore 2 down is not specifically recited. Washing or circulating the wellbore is needed if proppant or other sediments settle out of the fluid and collect at the bottom. Circulating the well may also be needed after perforating and before fracturing because it is undesirable for the fluid in the annulus to make its way into the reservoir.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method of fracturing a multi-zone subterranean formation intersected by a wellbore, comprising the steps of:

introducing perforations into a second zone in the multi-zone subterranean formation;

injecting a fracturing fluid into perforations formed in a second zone in the multi-zone subterranean formation by pumping the fracturing fluid down an annulus formed between the wellbore and a tubing string having a bottom-hole assembly ("BHA") attached to an end thereof; and simultaneously flowing back previously placed fracturing fluid in a first zone to the surface through the BHA and tubing string;

wherein the steps are performed in a single trip into the wellbore.

2. The method according to claim 1 further comprising the step of isolating the first zone from the second zone.

3. The method according to claim 2 wherein the BHA comprises a packer, and the first zone is isolated from the second zone by setting the packer between the first zone and the second zone.

4. The method according to claim 3 wherein the packer is unset and the BHA is moved up hole adjacent a third zone after completing the step of injecting the fracturing fluid into perforations formed in a second zone.

5. The method according to claim 4 wherein the BHA further comprises a hydra jetting sub, and after the BHA has moved up hole, the third zone is perforated by ejecting a hydraulic fluid from jet ports in the hydra jetting sub into the subterranean formation at sufficient pressure to cause perforations to be formed in the third zone.

6. The method according to claim 5 further comprising the step of setting the packer between the second zone and third zone.

7. The method according to claim 6 further comprising the step of injecting a fracturing fluid into the perforations in the third zone by pumping the fracturing fluid down the annulus formed between the tubing string and the wellbore.

8. The method according to claim 7 further comprising the step of flowing back previously placed fracturing fluid in the first and second zones to the surface through the BHA and tubing string while the perforations in the third zone are being fractured.

9. The method according to claim 1 wherein the BHA includes a hydra jetting sub, and the second zone is perforated by ejecting a hydraulic fluid from jet ports of the hydra jetting sub into the subterranean formation at sufficient pressure to cause perforations to be formed.

10. The method according to claim 9 further comprising the step of initiating a fracture in the second zone prior to injecting the fracturing fluid through the annulus by ejecting a fracturing fluid from the jet ports of the hydra jetting sub.

11. The method according to claim 1 wherein the previously placed fracturing fluid enters the BHA through a valve sub attached at a bottom end of the BHA.

12. The method according to claim 1 wherein the second zone is located up hole from the first zone.

13. A method of fracturing a multi-zone subterranean formation intersected by a welibore, comprising the steps of:

(a) running a bottom-hole assembly ("BHA") attached to an end of a tubing string into the wellbore adjacent to a first zone to be fractured, wherein the BHA comprises a hydra jetting sub and a packer attached below the hydra jetting sub;

(b) perforating the first zone of the subterranean formation by injecting a hydraulic fluid into the subterranean formation through jet ports of the hydra jetting sub;

(c) moving the BHA downhole below the first zone;

(d) setting the packer;

(e) pumping a fracture fluid down an annulus formed between the tubing string and the wellbore and into the perforations formed in the first zone;

(f) unsetting the packer;

(g) pulling the BHA up hole so that the hydra jetting sub is adjacent to a second zone;

(h) perforating the second zone of the subterranean formation by injecting a hydraulic fluid into the subterranean formation through the jet ports of the hydra jetting sub;

(i) setting the packer;

(j) pumping a fracture fluid down the annulus and into the perforations formed in the second zone; and (k) simultaneous with step (j) flowing back previously placed fracturing fluid in the first zone to the surface through the BHA and tubing string.

14. The method according to claim 13 further comprising the step of repeating steps (g) through (k) to perforate and fracture a third zone and simultaneously flow back previously placed fracturing fluid in the first and second zones to the surface through the BHA and tubing string.

15. The method according to claim 13 further comprising the step of initiating a fracture in the second zone prior to performing step (j) by ejecting fracture fluid from the jet ports of the hydra jetting sub.

16. The method according to claim 13 wherein the steps of setting the packer comprise the steps of:

rotating the tubing string so as to align a plurality of wedges in the packer with a corresponding plurality of tapered sealing members; and pushing down on the tubing string so as to force the sealing members via the wedges into engagement with the inside surface of a casing within the wellbore.

17. The method according to claim 16 wherein the step of unsetting the packer comprises the steps of:

pulling up on the tubing string to remove the force on the sealing members applied by the wedges; and rotating the tubing string so as to place the wedges out of alignment with the sealing members.

18. The method according to claim 13 wherein previously placed fracturing fluid in the first zone enters the BHA and tubing string through a valve sub attached at a bottom end of the BHA.

19. A method of fracturing a multi-zone subterranean formation intersected by a wellbore, comprising the steps of:

introducing perforations into a second zone in the multi-zone subterranean formation;

injecting a fracturing fluid into perforations formed in a second zone in the multi-zone subterranean formation; and simultaneously flowing back previously placed fracturing fluid in a first zone to the surface through a tubing string;

wherein the steps are performed in a single trip into the wellbore.

20. The method according to claim 19 wherein the step of injecting a fracturing fluid into the perforations formed in the second zone is performed by pumping the fracturing fluid down an annulus formed between the tubing string and the wellbore.

21. The method according to claim 20 further comprising the step of sealing the annulus between the tubing string and the wellbore between the first zone and the second zone.

22. The method according to claim 21 wherein the step of sealing the annulus between the tubing string and the wellbore is performed by a setting a compression-type packer coupled to an end of the tubing string.

23. The method according to claim 19 further comprising the steps of:

forming perforations in a third zone and injecting a fracturing fluid into those perforations; and simultaneously flowing back previously placed fracturing fluid in the first and second zones to the surface through the tubing string.

24. The method according to claim 23 wherein the step of forming perforations in the third zone is performed by injecting a hydraulic fluid into the subterranean formation through jet ports of a hydra jetting sub coupled to an end of the tubing string.

25. The method according to claim 19 wherein the perforations in the second zone are formed by injecting a hydraulic fluid into the subterranean formation through jet ports of a hydra jetting sub coupled to an end of the tubing string.

26. The method according to claim 19 further comprising the step of initiating a fracture in the second zone by injecting a fracturing fluid into the perforations through jet ports of a hydra jetting sub coupled to an end of the tubing string.

27. The method according to claim 19 wherein the second zone is located up hole from the first zone.

* * * * *